US008656557B2

(12) United States Patent
Stull

(10) Patent No.: US 8,656,557 B2
(45) Date of Patent: Feb. 25, 2014

(54) GATE HINGE ASSEMBLY

(75) Inventor: Edward J. Stull, Oxford, MI (US)

(73) Assignee: Turnstyle Intellectual Property, LLC, Oxford, MI (US)

( * ) Notice: Subject to any disclaimer, the term of this patent is extended or adjusted under 35 U.S.C. 154(b) by 405 days.

(21) Appl. No.: 12/939,577

(22) Filed: Nov. 4, 2010

(65) Prior Publication Data

US 2011/0099754 A1 May 5, 2011

Related U.S. Application Data

(60) Provisional application No. 61/257,936, filed on Nov. 4, 2009, provisional application No. 61/222,638, filed on Jan. 14, 2010.

(51) Int. Cl.
*E05D 7/04* (2006.01)

(52) U.S. Cl.
USPC ..... 16/245; 16/86.1

(58) Field of Classification Search
USPC ..... 16/235–248, 387, 388, 389, 86.1, 86.2
See application file for complete search history.

(56) References Cited

U.S. PATENT DOCUMENTS

| | | | | |
|---|---|---|---|---|
| 4,785,498 | A * | 11/1988 | Brotschi | 16/238 |
| 5,822,832 | A * | 10/1998 | Maggi | 16/276 |
| 7,269,880 | B2 * | 9/2007 | Wallis et al. | 16/237 |
| 2004/0093689 | A1 * | 5/2004 | Sosa et al. | 16/301 |

* cited by examiner

*Primary Examiner* — Jeffrey O Brien
(74) *Attorney, Agent, or Firm* — Carlson, Gaskey & Olds, P.C.

(57) ABSTRACT

An example hinge assembly includes a movable insert that supports a gate. The insert includes a bearing assembly that is movable relative to support structure to provide for alignment and adjustment of the gate structure. An adaptor is supported by the bearing assembly and provides for attachment of a gate component. The adaptor may be configured to insert within a hollow interior portion of a plastic or vinyl fence component. The adaptor may also include features for mounting traditional materials such as wood or steel.

7 Claims, 10 Drawing Sheets

GATE HINGE ASSEMBLY

CROSS REFERENCE TO RELATED APPLICATION

This application claims priority to U.S. Provisional Application No. 61/257,936 filed on Nov. 4, 2009 and U.S. Provisional Application No. 61/222,638 filed on Jan. 14, 2010.

BACKGROUND OF THE INVENTION

This disclosure relates to a hinge for supporting a movable gate assembly. More particularly, this disclosure relates to a hinge for supporting a movable gate assembly that is adjustable.

Traditional gate hinge assemblies are fixed to a support structure such as a fixed post or other fixed structure. In is often the case that support structures on either side of the gate are not aligned with each other and therefore result in a misaligned gate. Convention, methods of aligning the gate include shimming, or custom fabrication on-site. Such custom adjustments are difficult to install and cannot accommodate all mis-alignment problems. Moreover, any shifting of the support structures as may occur over time is not accommodated by such initial custom installations.

SUMMARY

A disclosed example hinge assembly includes a movable insert that supports a gate. The insert includes a bearing assembly that is movable relative to a support structure to provide for alignment and adjustment of the gate structure. An adaptor is supported by the bearing assembly and provides for attachment of a gate component. The adaptor may be configured to insert within a hollow interior portion of a plastic or vinyl fence component. The adaptor may also include features for mounting traditional materials such as wood or steel. An adjustment member provides for horizontal movement of the bearing assembly and thereby the adaptor such that the gate may be aligned once the hinge is secured to the support structure. Moreover, the bearing assembly includes features that substantially reduce friction to reduce the forces required to open and close a gate.

These and other features disclosed herein can be best understood from the following specification and drawings, the following of which is a brief description.

DETAILED DESCRIPTION

Figure 1:
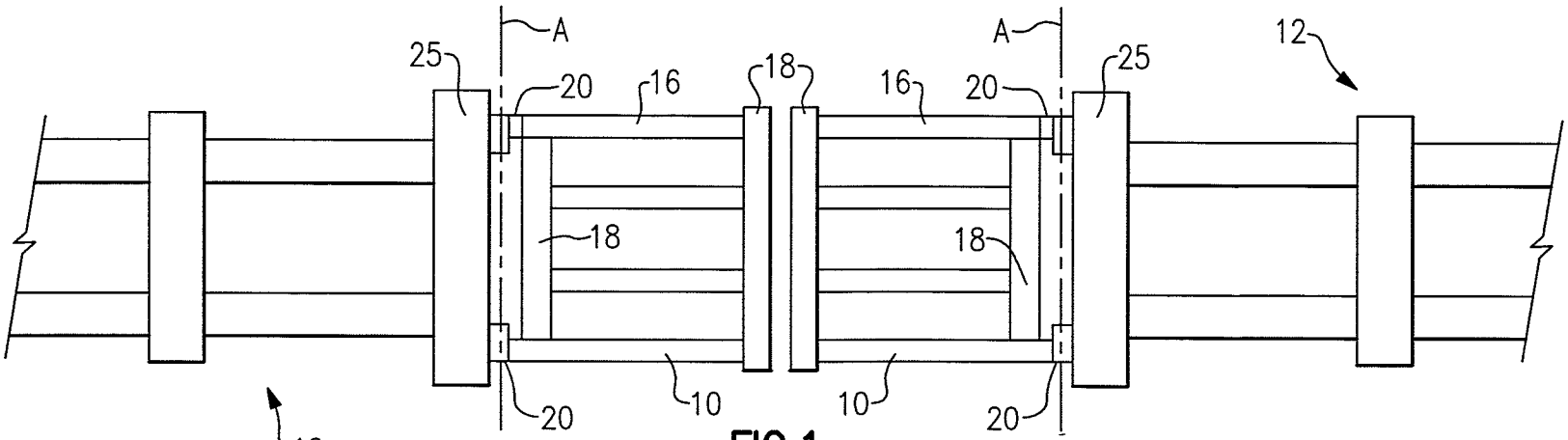
FIG. 1 is a schematic view of a gate supported by an example hinge.
Figure 2:
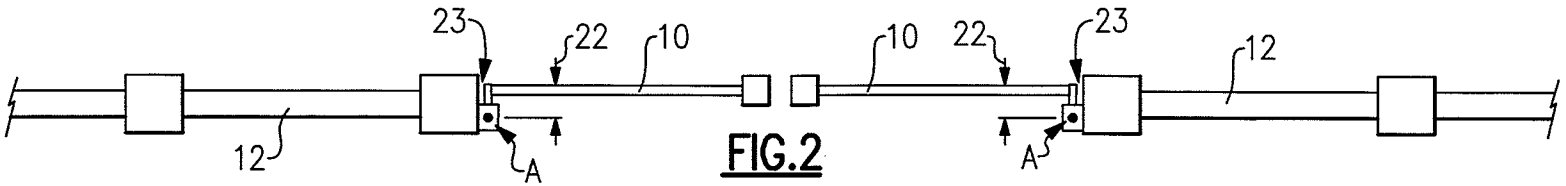
FIG. 2 is a top schematic view of a gate supported by an example hinge.
Figure 3A:
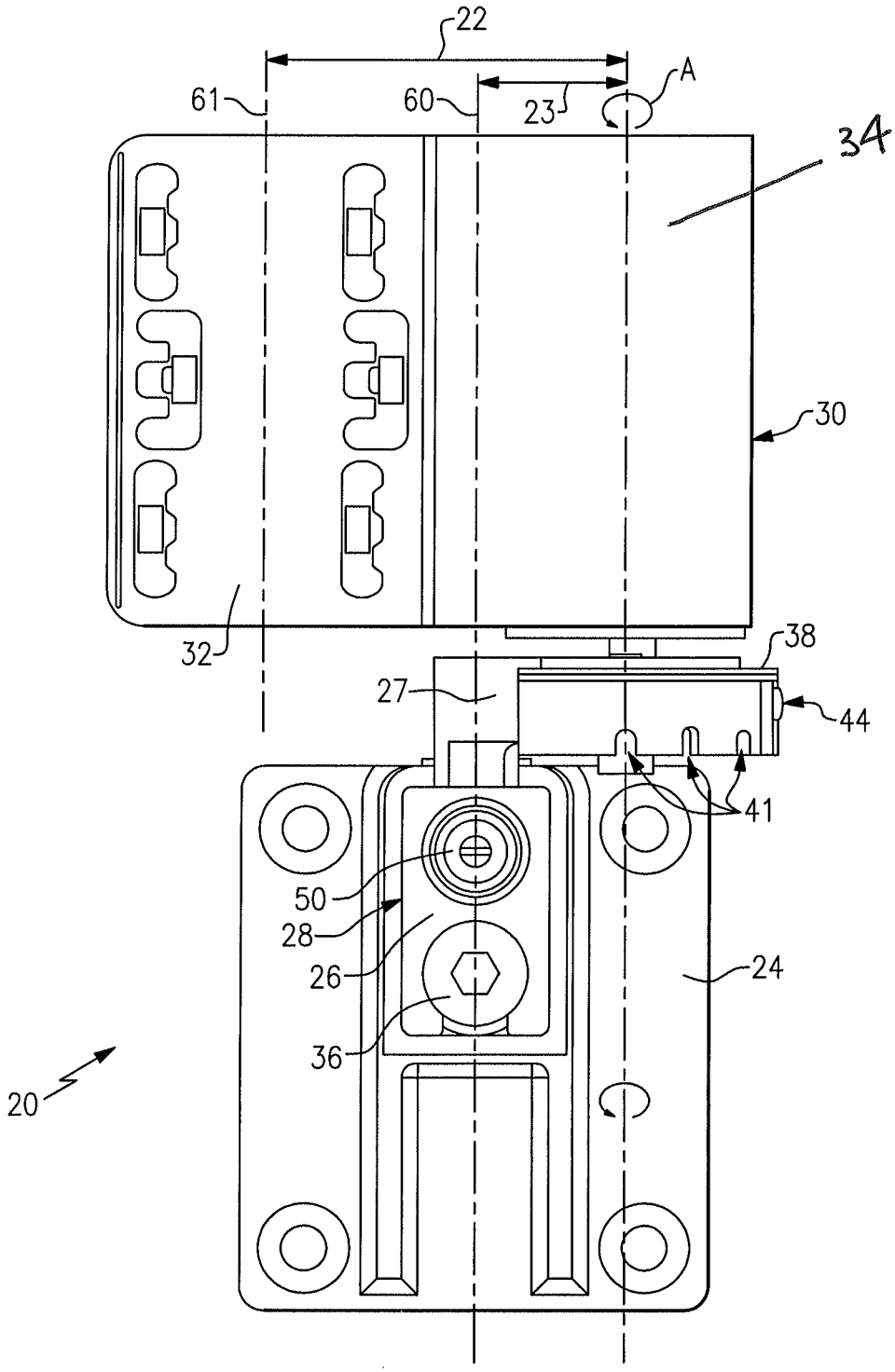
FIG. 3A is a front view of an example hinge independent of any gate structure.
Figure 3B:
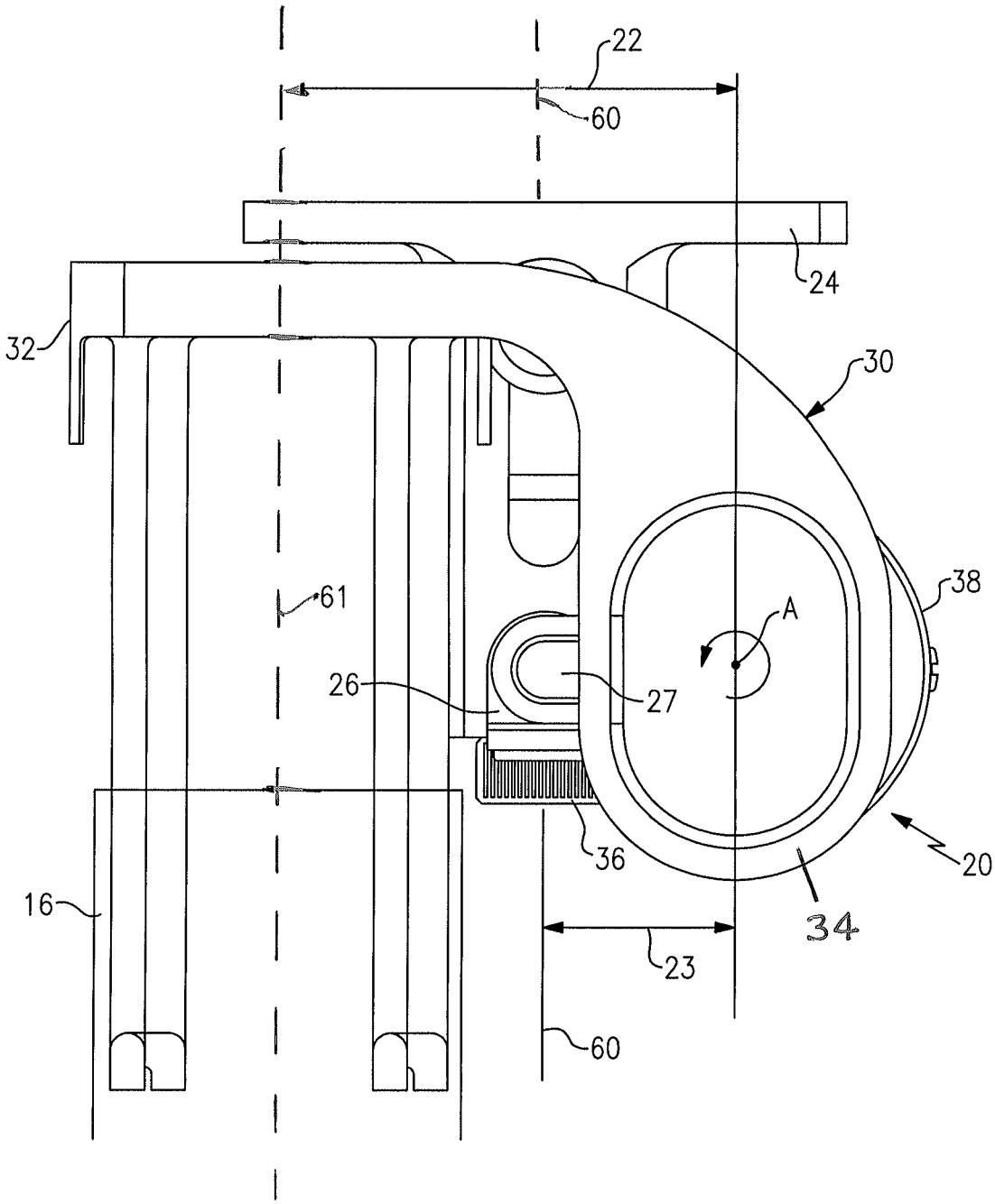
FIG. 3B is a top view of the example hinge shown in FIG. 3A.
Figure 4A:
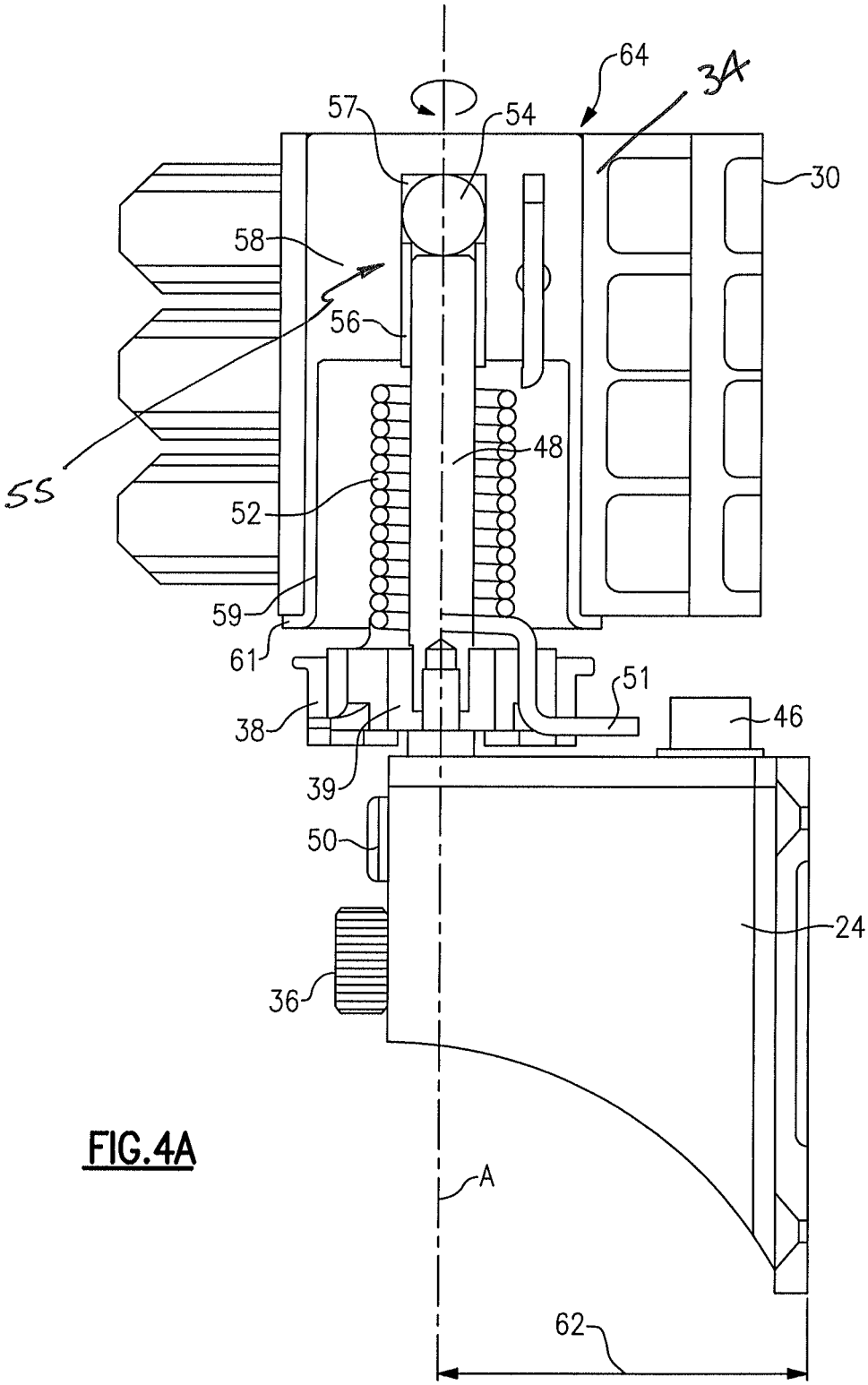
FIG. 4A is a cross-sectional view through a portion of the example hinge shown in FIGS. 3A and 3B.
Figure 4B:
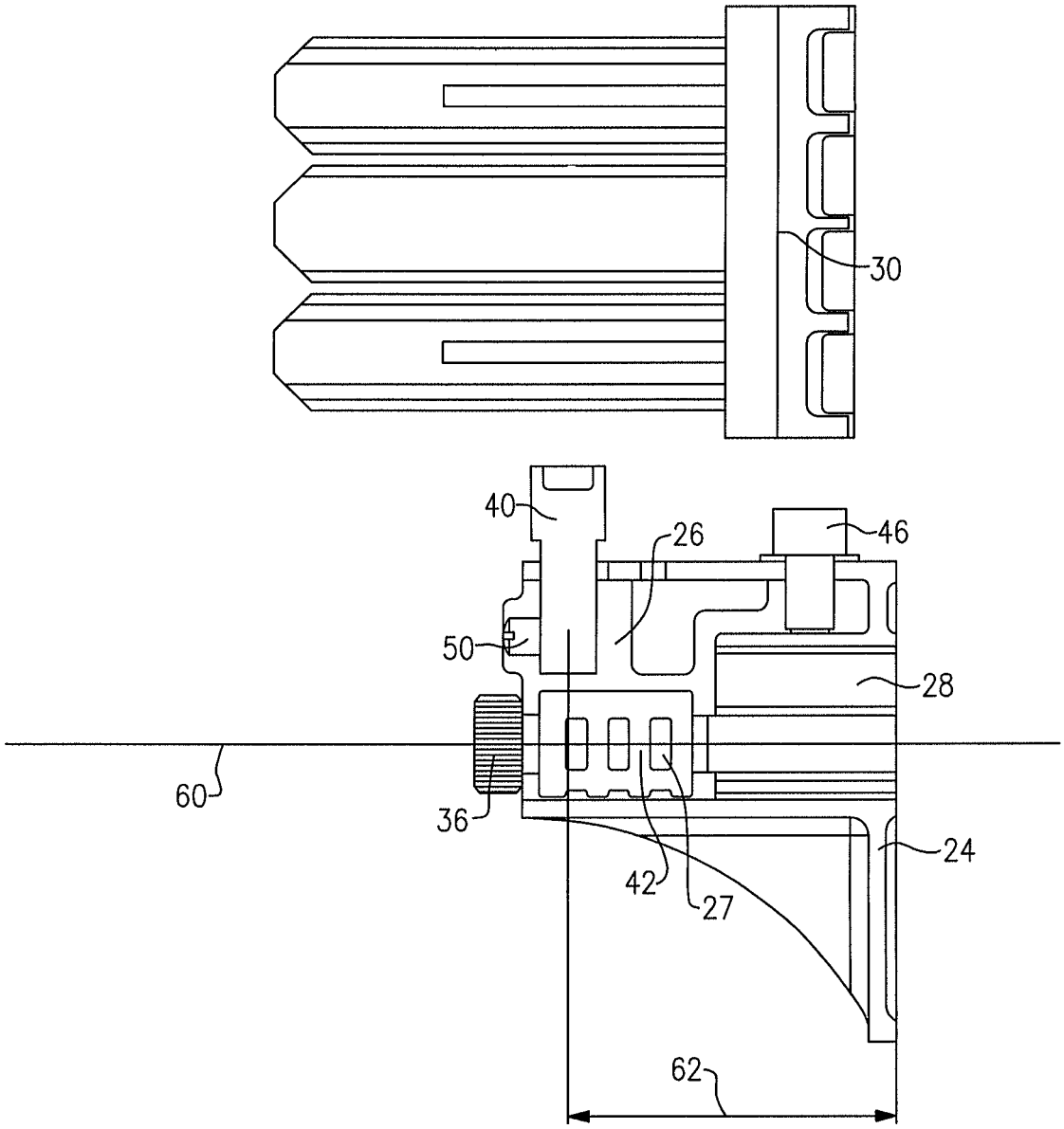
FIG. 4B is a cross-sectional view through another portion of the example hinge shown in FIGS. 3A and 3B.

Referring to FIGS. 1 and 2, gates 10 are supported by hinges 20 from posts 25. The gates 10 rotate about axis A between open and closed positions to provide access through the fence 12. The example gates 10 include rails 16 that extend between posts 18. The rails 16 are attached to the corresponding hinge 20 such that the gates 10 are supported for rotation about the axis A. Each of the gates 10 are spaced apart from the corresponding support post 25 to provide a desired clearance that facilitates rotation. The example gate 10 is spaced apart from the axis A, a distance 22 such that a smaller gap 23 can be provided between the gate 10 and the support post 25. The smaller gap 23 is desirable in some installations and is facilitated by the configuration of the example hinges 20.

Referring to FIGS. 3A, 3B, 4A and 4B, the example hinge 20 includes a housing 24 that is attachable to a support structure such as the example post 25 or other fixed structures. The housing 24 defines a cavity 28 that receives an insert 26. The insert 26 is movable along a vertical plane 60 to adjust a size of the gap 23 (FIG. 2). An adjustment screw 36 is supported within the insert 26 and is engaged by way of threads such that rotation of the adjustment screw 36 produces movement of the insert 26 along the vertical plane 60. The adjusting screw 36 is rotatably secured within the insert by a retainer 42. The adjustment screw 36 may abut a back surface of the mount 24. A screw 46 is provided in the mount 24 to secure the insert 26 in position once a desired adjusted position is obtained.

The inert 26 supports a bearing assembly 55 that includes a pivot pin 48 that is secured within the insert 26 by way of support 40 by a set screw 50. The pivot pin 48 is attached to the support 40 by way of offset member 27 and extends up into the bearing assembly 55. The offset member 27 provides for a spacing 23 between the centerline plane 60 and the axis of rotation A. The pivot pin 48 extends upward from the insert 24 and provides for support of an adapter 30. The pivot pin 48 is disposed along the axis A such that the gate 10 rotates about the axis A defined along the pivot pin 48. The pivot pin 48 supports a ball bearing 54 on which the adapter 30 is supported.

The pivot pin 48 extends through a bearing sleeve 56 that is supported within a sleeve 58. A sleeve 58 includes an open cavity 59 within which a spring 52 is mounted. The sleeve 58 includes a flange 61 that supports the adapter 30. The adapter 30 in turn defines a cavity 64 that fits over the sleeve 58. The fit between the sleeve 58 and the cavity 64 provides a tight fit that is substantially free of relative movement such that the adapter 30 is supported and moves with the sleeve 58 about the axis A.

The return spring 52 is disposed about the pivot pin 48 and is secured on one end to the sleeve 58 and on a second end to spring adjustment ring 38. The spring adjustment ring 38 includes a plurality of slots 41 that receive an end 51 of the return spring. The spring adjustment ring 38 is movable upwardly such that the free end 51 of the return spring does not engage one of the plurality of slots 41, thereby allowing free movement of the gate without return biasing force. The spring adjustment ring 38 is supported on an inner ring 39 that defines a space through which the spring end 51 extends. A screw 44 secures the spring adjustment ring in place once a desired biasing force is set.

The return spring 52 generates a biasing force to cause rotation of the adapter 30 toward a desired closed position. In this disclosed example the spring 52 comprises a coil spring that wraps about the pivot pin 48, however it is within the contemplation of this disclosure to provide other biasing members to provide the desired return biasing force. The biasing force is adjusted by selecting a desired one of the slots 41 in the spring adjustment ring 38 that winds the spring 52 to set a desired preload. Alternatively, securing the adjustment ring 38 in an upper position such that the free end of the spring 51 cannot engage any of the slots 41 provides free non-biased operation of the hinge 20.

The ball bearing 54 is disposed between a top surface of the pivot pin 58 within a top portion of a cavity within the sleeve 58 that receives both the ball bearing 54 and a portion of the pivot pin 48. The cavity receiving the ball bearing 54 provides a small clearance fit for the pivot pin 48 and the ball bearing 54. Accordingly, the sleeve 58 includes the cavity 57 that is sized just larger than a diameter of the pivot pin and the ball bearing 54. The diameter of the ball bearing 54 and the pivot pin are substantially equal.

The adapter 30 includes a mount portion 34 that defines the cavity 64 that fits over the sleeves 58, 59 of the bearing assembly 55. The adapter 30 also includes attachment portion 32 that is secured to a portion of the gate structure. In this example the attachment portion 32 is received within a hollow interior portion of a prefabricated rail. Fencing components fabricated from plastics and vinyl materials are replacing the use of conventional wood and steel fencing due to cost and ease of installation. However, hinge assemblies have not adapted to the use of these materials. The example adapter 30 includes the attachment portion 32 that is received within the hollow internal structure of a fabricated rail member 16. Furthermore, the adapter 30 is fabricated from a common material such that installation and/or attachment to the rail 16 can be accomplished using adhesives commonly utilized in fabricating the example fence 12.

The example hinge 20 offsets the axis of rotation A from a centerline of the part indicated by plane 60 a distance 23. A centerline of the 61 of the adapter 30 is offset from axis of rotation A distance 22. The offset orientation of the axis of rotation A and the centerline of the adaptor 30 provides for centering of a gate structure on a gate post that is not much larger than the width of the mount 24. Moreover, the offset adaptor 30 allows for the gate to extend past the axis or rotation to close the gap 23 between the post 25 and the gate structure.

Figure 5:
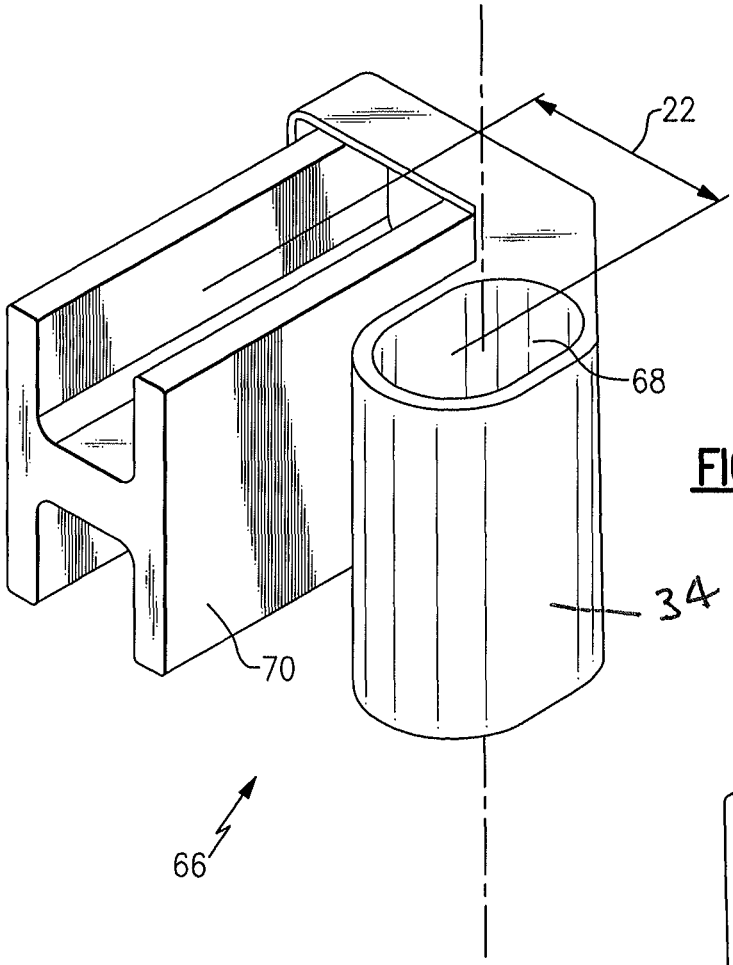
FIG. 5 is a perspective view of an example adapter.

Referring to FIG. 5, another example adapter 66 is shown that includes the mount portion 68 that is configured much like that of the example adapter 30 shown in FIGS. 3 and 4. The adapter 66 includes a differently configured attachment portion 70 that is compatible with other extruded and common shapes of plastic and/or vinyl fencing materials. Accordingly, the example hinge 20 can be fitted with an adapter that includes a shape that corresponds with the fencing utilized in a specific application and installation.

Figure 6:
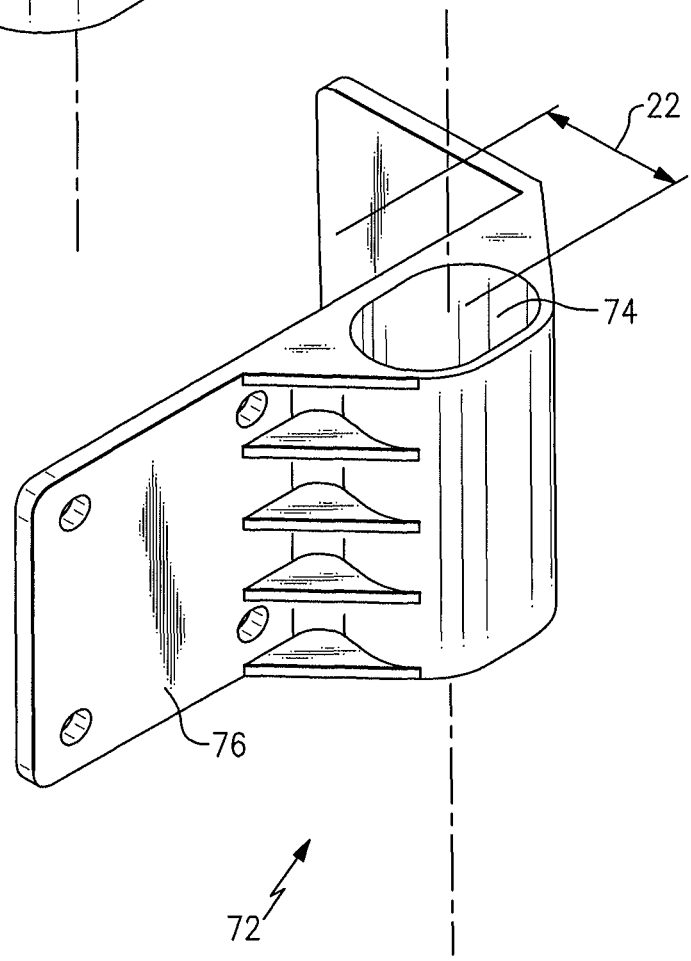
FIG. 6 is a perspective view of another example adapter.

Referring to FIG. 6, another example adapter 72 includes features that allow for the attachment of conventional material such as wood or steel by with the plate attachment portion 76 that includes openings for fasteners. Corresponding holes in the gate structure are created and fasteners are utilized to secure the gate structure to the adaptor 72. The adaptor 72 is then assembled to the hinge 20 by sliding the cavity 74 over the sleeves 58 and 59.

Moreover, each of the adaptors 30, 66 and 72 provide for the offsetting of the gate 10 to provide a reduced gap 23 between the support structure and post 25. The reduced gap size 23 provides not only a more desirable appearance but also eliminates potential pinch points.

Figure 7:
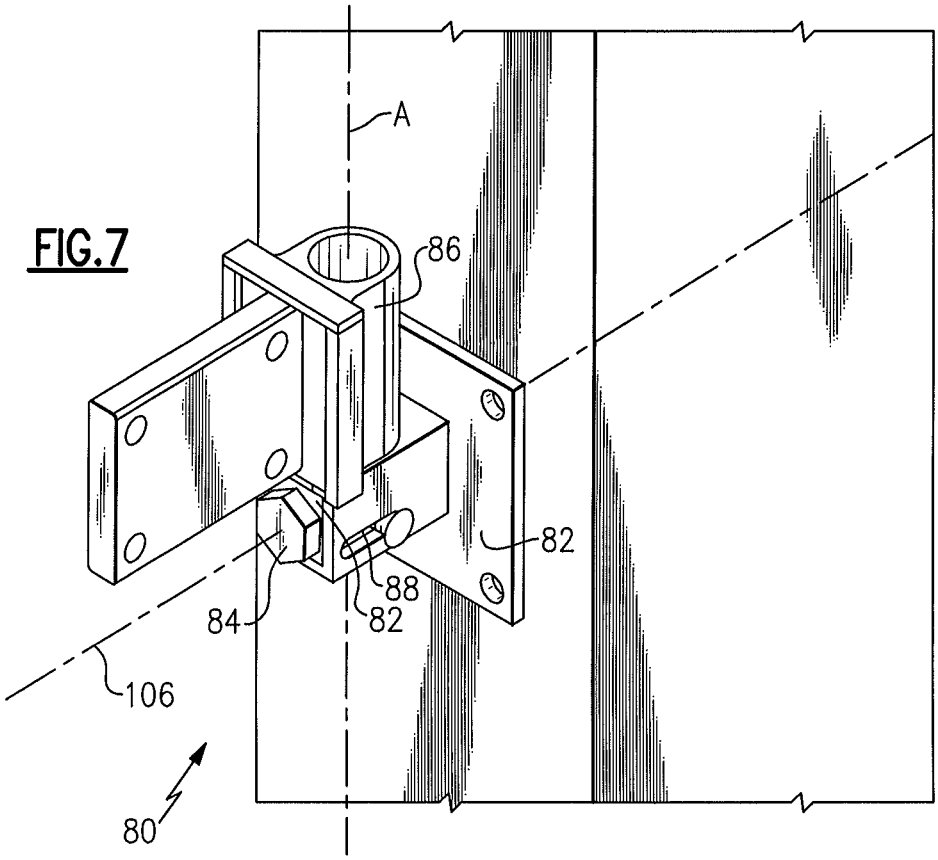
FIG. 7 is a perspective view of another example hinge.
Figure 8:
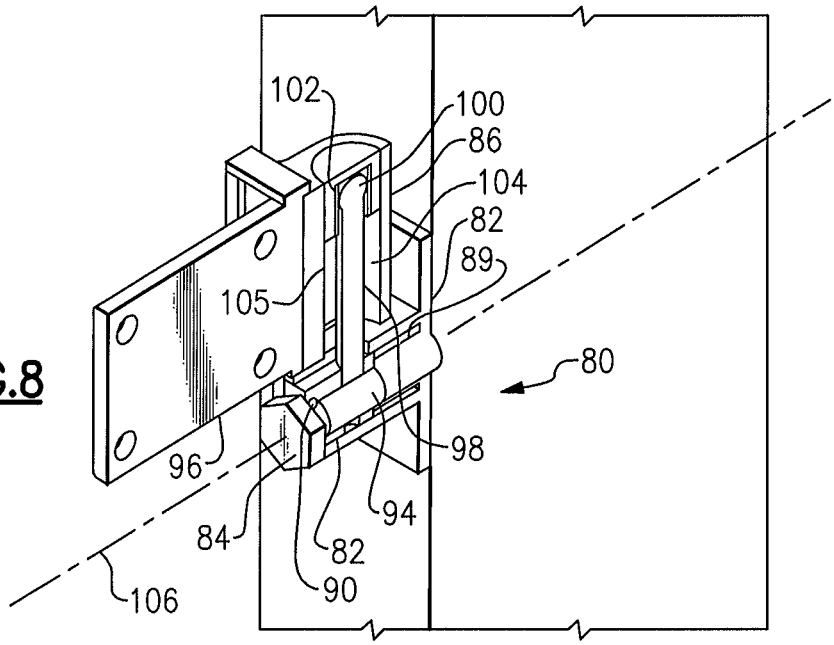
FIG. 8 is a cross-sectional view of the example hinge shown in FIG. 7.

Referring to FIGS. 7 and 8, another example hinge 80 includes a mount 82 for securement to a support structure along with an adapter 86 that fits onto a bearing assembly 106 and provides for the attachment of a gate 10. The bearing assembly 106 is disposed with cavity 104. The hinge 80 includes an insert 82 that is movable within a cavity 89 defined within a portion of the mount 82. The insert 82 supports a pivot pin 98 that includes a spherical end 100. The pivot pin 98 is attached to the insert and is movable along the vertical axis 105 in response to rotation of the adjustment screw 84. The adjustment screw 84 is captured within the insert 82 by a retaining pin 90 that is received within a groove 90. The groove 90 is formed in the adjustment screw 90 and cooperates with the retaining pin 92 to allow rotation to adjust a position of the pivot pin 98 and thereby the axis A. A slot 88 is provided in the mount 82 to limit movement of the insert 82.

The adapter 86 is supported on the spherical end 100 of the pivot pin within a bushing 100. The bushing 100 includes an inner sleeve 102 that provides a substantially reduced frictional interface to facilitate easy rotation and opening of the gate 10. The adapter 86 includes a mount portion 96 for attachment of a gate structural member such as the rail 16. The example mount portion 96 includes openings for fasteners for securing the gate structure.

Figure 9:
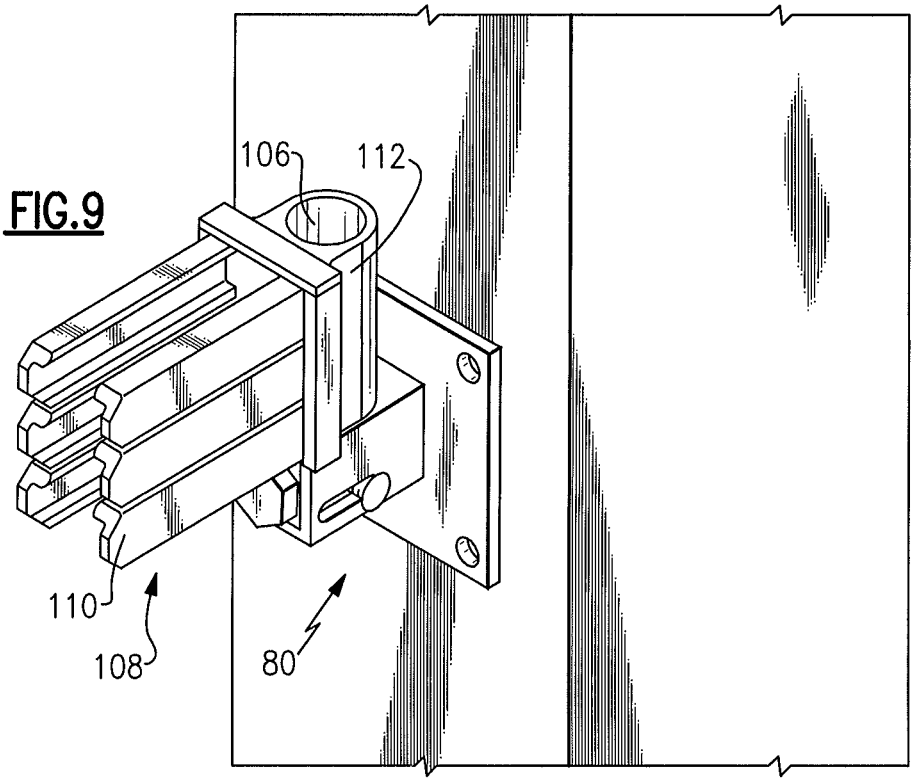
FIG. 9 is a perspective view of the example hinge shown in FIG. 7 including another example adapter.

Referring to FIG. 9, another example adaptor 108 includes a mount portion 112 that fits onto the bearing assembly 106 and an insert portion 110 that is received within a gate structural component to provide a rigid connection between the hinge 80 and the gate structure.

Figure 10:
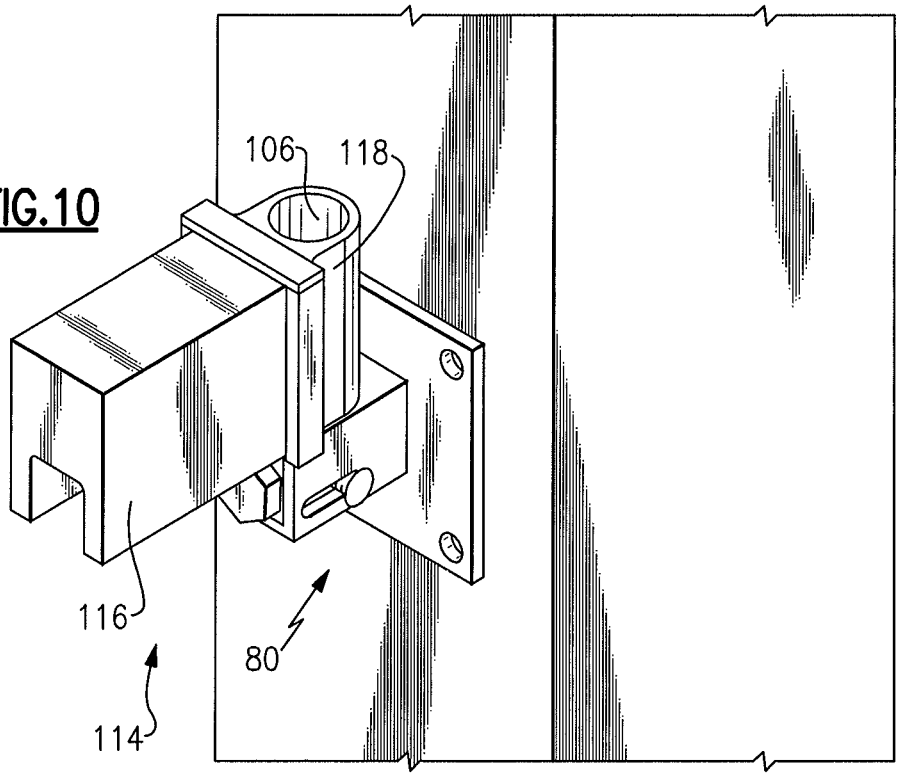
FIG. 10 is a perspective view of the example hinge shown in FIG. 7 including another example adapter.

Referring to FIG. 10, another example adaptor 114 includes the mount portion 118 that fits onto the bearing assembly 106. The mount portion 118 is of a common configuration to provide for wide use across many different application and gate component configurations. The attachment portion 116 includes a shape with a channeled under portion for fitting a rail component of a corresponding configuration. As appreciated, the shape of the example attachment portions 116 can be adapted to required shapes and dimensions to facilitate attachment and installation of common fence components. Moreover, the example hinge 80 can be utilized with many different gate and fence profiles and shapes.

Figure 11:
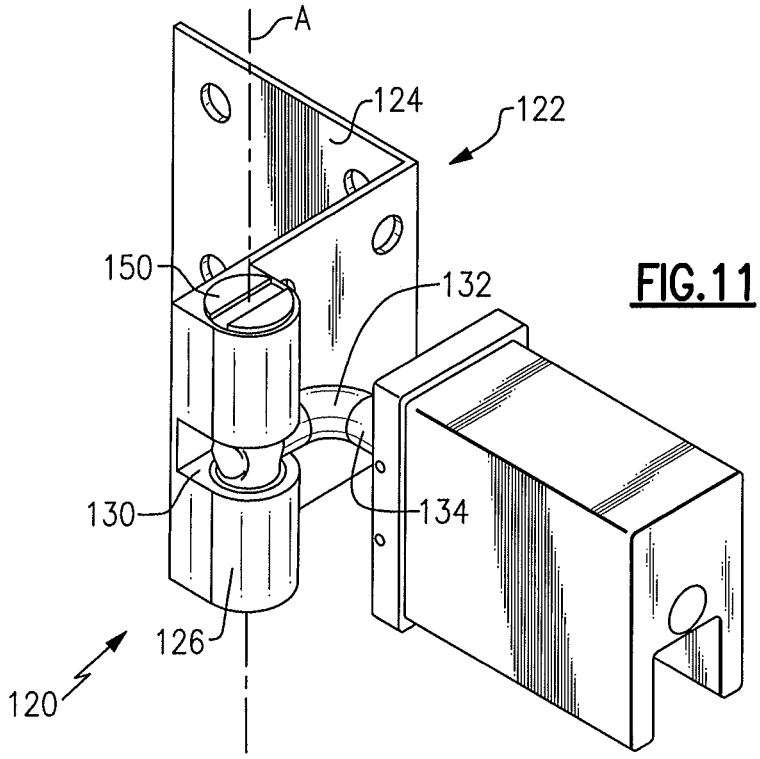
FIG. 11 is a perspective view of another example hinge.
Figure 12:
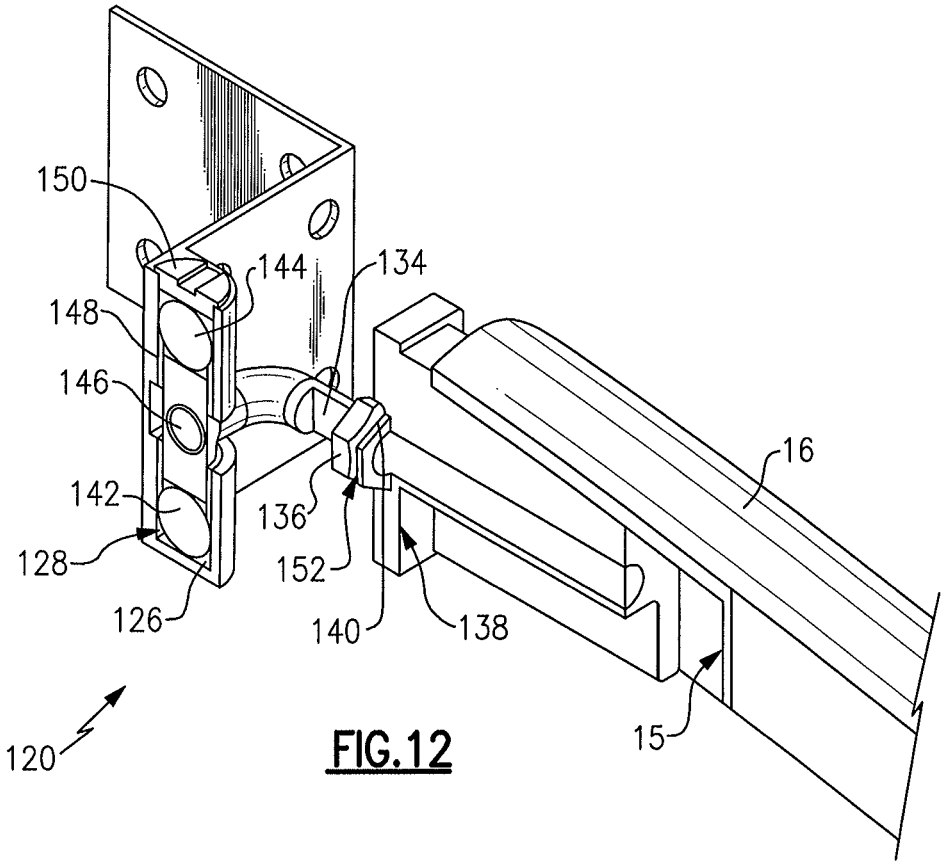
FIG. 12 is a cross-sectional view of the example hinge shown in FIG. 11.

Referring to FIGS. 11 and 12, another hinge 120 includes a mount 122 that defines a plate portion 124 for securement to a support structure and a bearing cavity 126 that supports a bearing assembly 128 (FIG. 12). The bearing cavity 126 includes a slot 130 through which an adjustment arm 132 extends. The adjustment arm 132 includes a threaded portion 134 and adjustment nut 136. The adjustment nut 136 is retained within an adaptor 138 by a retainer pin 140. Rotation of the adjustment nut 136 causes movement of the adaptor 138 to provide adjustment and alignment of the gate.

The bearing assembly 128 includes a first ball bearing 142 disposed at a bottom portion of the cavity 126. A pivot pin 146 sits atop the first ball bearing 142 and is received within a bearing sleeve 148. The bearing sleeve 148 reduces frictional interference with rotation of the pivot pin 146. The example bearing sleeve 148 is brass, however other materials may also be used. A second ball bearing 144 is disposed atop the pivot pin 146 and is held within the bearing cavity by a plug 150. The adjustment arm 132 is secured to the pivot pin 146 and is thereby supported for rotation about the axis A.

The adjustment nut 136 includes the groove 152 that receives the retaining pin 140. The retaining pin 140 is secured within the adapter 138 and extends into an inner bore that receives a portion of the adjustment nut 136.

Installation of the example hinge 120 includes mounting to a support structure such as the example post 125. Mounting is facilitated by attachment of the plate portion 124 of the mount 122 to the example post 25 (FIG. 1). A gate structure such as rail 16 that includes an interior space 15 is assembled to the adaptor 138. In this example, the adaptor 138 is received within the interior space 15 and secured by adhesive or mechanical fasteners. The hinge 120 can be attached to the gate structure 10 prior to mounting to the support structure. Alternatively, the gate structure can be fabricated with the hinge already mounted.

Once mounted, the gate 10 can be adjusted by rotation of the adjustment nut 136 to adjust a gap between adjacent gates. Moreover, upper and lower hinges are independently adjustable to provide additional alignment capabilities.

As appreciated, gate members can be fabricated from hollow structures specifically hollow plastic or vinyl structures. The structures are typically utilized in the fabrication of vinyl gates and are a modular system. The disclosed gate hinge assembly provides a gate hinge that is specifically designed to adapt and conform to the interior surfaces of hollow modular members utilized for creating and defining a gated area. The example adaptor fits onto the retainer of the adjustment arm and is movable in and out in response to rotation of the adjustment nut. As appreciated, various forms of adaptors can be utilized along with the example gate hinge assembly.

Figure 13:
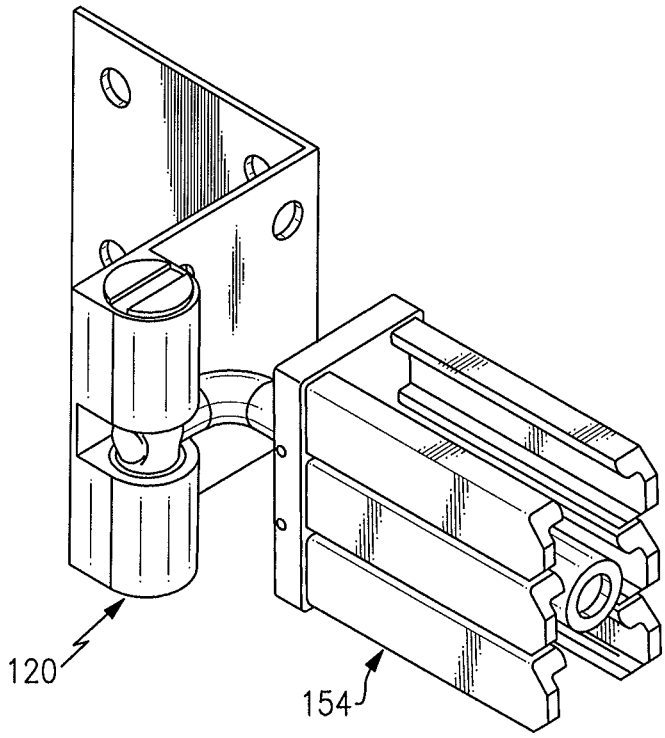
FIG. 13 is a perspective view of the example hinge shown in FIG. 11 with another example adapter.

Referring to FIG. 13, an example adaptor 154 is receivable within a hollow gate structure or other member. The adaptor 154 is insertable into a hollow gate structure such as an exterior vinyl portion.

Figure 14:
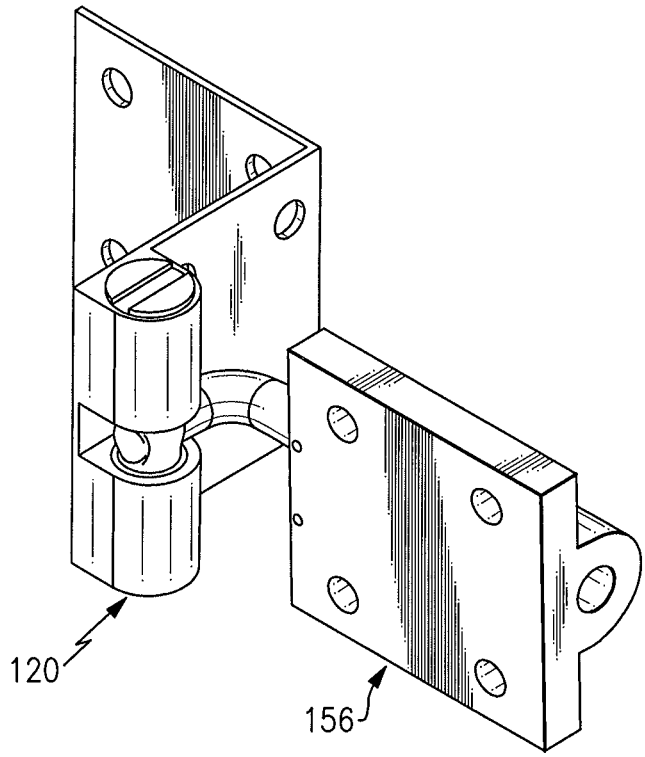
FIG. 14 is a perspective view of the example hinge shown in FIG. 11 with another example adapter.

Referring to FIG. 14, another example adaptor 156 is provided for mounting traditional materials such as wood, or metal. Moreover, the adaptor 156 could be utilized as a universal adaptor for mounting gates of a custom configuration. Other adaptors could also be fabricated to tailor installation to a particular gate and/or fence structure profile.

The example disclosed hinge assemblies provide for the installation and adjustment of gates fabricated from preformed shapes and configurations. Moreover, the example hinge assemblies provide an easy and reliable means of adjusting gate position without shims or other custom fabrications.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A gate hinge assembly comprising:

a housing mountable to a fixed structure;

a support movable mounted for horizontal movement relative to the housing;

a bearing assembly attached to the support and moveable with the support relative to the housing, the bearing assembly defining a vertical axis, wherein the bearing assembly comprises a pivot pin extending along the vertical axis from the support and a ball bearing supported between the pivot pin and the adapter; and an adapter supported on the bearing assembly and rotatable about the vertical axis, the adapter including an attachment portion for attachment to a gate structure; the pivot pin is attached to the support by way of an offset member, wherein the vertical axis is offset a distance from a plane through a centerline of the support that is parallel to the vertical axis.

2. The gate hinge assembly as recited in claim 1, wherein the housing defines a cavity and the support includes an insert received within the cavity and movable relative to the housing, the insert supporting the bearing assembly and a threaded member for facilitating movement of the insert relative to the housing.

3. The gate hinge assembly as recited in claim 2, including a retainer for holding the threaded member within the insert, wherein the threaded member extends through the insert and into contact with a surface of the housing such that rotation of the threaded member generates horizontal movement of the insert relative to the housing.

4. The gate hinge assembly as recited in claim 2, including a return spring supported between the adapter and the insert for generating a biasing force on the adapter in a rotational direction toward a desired closed position.

5. The gate hinge assembly as recited in claim 1, wherein the adapter includes a mount portion that is supported on the bearing assembly.

6. The gate hinge assembly as recited in claim 5, wherein the attachment portion includes an insert portion that is receivable within a cavity defined by a gate structure.

7. The gate hinge assembly as recited in claim 5, wherein the adapter is offset a transverse distance from the vertical axis for providing a desired minimal distance between a gate structure and support post.

* * * * *

UNITED STATES PATENT AND TRADEMARK OFFICE

CERTIFICATE OF CORRECTION

PATENT NO. : 8,656,557 B2
APPLICATION NO. : 12/939577
DATED : February 25, 2014
INVENTOR(S) : Stull It is certified that error appears in the above-identified patent and that said Letters Patent is hereby corrected as shown below:

IN THE CLAIMS:

Claim 1, column 6, line 17: delete “the” and replace with --an--

Claim 1, column 6, line 18: delete “an” and replace with --the--

Signed and Sealed this
Twenty-seventh Day of May, 2014

Michelle K. Lee

Michelle K. Lee
*Deputy Director of the United States Patent and Trademark Office*